US005890310A

United States Patent [19]

Bogstrom

[11] Patent Number: 5,890,310

[45] Date of Patent: Apr. 6, 1999

[54] LOCKING DEVICE, E.G. FOR WEAPONS OR THE LIKE

[76] Inventor: Rolf Bogstrom, Box 5078, 165 11 Hässelby, Sweden, S-165 11

[21] Appl. No.: 809,922

[22] PCT Filed: Oct. 9, 1995

[86] PCT No.: PCT/SE95/01158

§ 371 Date: Apr. 10, 1997

§ 102(e) Date: Apr. 10, 1997

[87] PCT Pub. No.: WO96/11373

PCT Pub. Date: Apr. 18, 1996

[30] Foreign Application Priority Data

Oct. 11, 1994 [SE] Sweden ..... 9403450

[51] Int. Cl.[6] ..... F41A 17/00

[52] U.S. Cl. ..... 42/70.11

[58] Field of Search ..... 42/70.11

[56] References Cited

U.S. PATENT DOCUMENTS

| | | | |
|---|---|---|---|
| 3,816,950 | 6/1974 | Vesamaa | 42/16 |
| 4,398,366 | 8/1983 | Wernicki | 42/1 LP |
| 5,048,211 | 9/1991 | Hepp | 42/70.11 |
| 5,054,223 | 10/1991 | Lee | 42/70.11 |
| 5,115,589 | 5/1992 | Shuker | 42/70.11 |
| 5,289,653 | 3/1994 | Szebeni et al. | 42/70.11 |

FOREIGN PATENT DOCUMENTS

| | | |
|---|---|---|
| 9303917 | 5/1995 | Sweden . |
| 2234047 | 1/1991 | United Kingdom . |

*Primary Examiner*—Charles T. Jordan
*Assistant Examiner*—Meena Chelliah
*Attorney, Agent, or Firm*—Dowell & Dowell, P.C.

[57] ABSTRACT

A locking device for weapons or similar structures with an elongated hollow body intended to fit into the barrel of the weapon. The body is provided with at least two telescoping parts. A locking device is inserted in the body and is expandable in such a way that the body is fixedly locked in the barrel. The locking device includes locking members arranged around the periphery of one part and another part presses the locking members radially outwards against the inner barrel surface when the parts are urged toward one another in an attempt to press the locking device out of the weapon.

16 Claims, 3 Drawing Sheets

LOCKING DEVICE, E.G. FOR WEAPONS OR THE LIKE

Background of the Invention

1. Field of the Invention

The present invention relates to a locking device, e.g. for weapons or similar items, the locking device comprising an elongated hollow body intended to fit into the barrel of the weapon or a similar item with a small clearance, said body being provided with at least two telescoping parts, a locking device inserted in the body during telescoping achieving an expansion of one of the parts in such a way that the body is fixedly locked m the barrel.

2. History of the Related Art

In a locking device of this type known from GB-A-2,234,047 one of the parts is provided with a slotted ring with an inner tapered shape, the other part having a tapered pin, against which the ring is resting. When rotating the locking device so that the parts are pushed together, the ring travels up on the tapered pin and expands radially towards the inner barrel mantle surface, whereby the body is fixedly locked in the barrel. When the key is removed from the locking device the weapon thus becomes unusable by means of the body locked in the barrel. At the opposite end of the locking body from the locking device a releasing device is arranged, which by means of an explosive charge shoots a number of locking pins against the inner barrel mantle surface with a sufficiently high pressure at this end applied on the locking body.

It has been proved that the known locking device has certain disadvantages. The ring expansion against the inner barrel mantle surface is performed by contracting the two locking barrel parts a predetermined length, e.g. by means of a threaded joint, the parts then being relatively immobile. By this the ring expands with a certain predetermined force so that the barrel is not damaged by indentations. This means that also the friction keeping the body locked in the barrel is limited. It has, therefore under certain conditions been impossible to shoot the locking body out of the barrel. The release of the explosive charge is performed by means of a piston acting on two springs to provide a pressure sufficiently large to project the piston powerfully against the charge. However, it has in practice been proved that an impact force has to be applied on the piston to release the charge, whereas a regular pressure applied against the locking body end enables to press the locking device out of the barrel without releasing the charge.

The main object of the present invention is to remove the weak points of the known locking device and to provide a locking device which cannot be removed from the barrel by pushing the locking device out from the barrel.

These and other objects are achieved according to the present invention by providing the locking device with the characteristics specified in the claims to follow.

The invention is described here below in connection with the drawings showing an execution example of the locking device.

FIG. 1 shows a longitudinal section of a locking device according to the invention, FIGS. 2*a* to 2*e* show various positions of the locking device for different locking conditions, FIG. 3 shows a longitudinal section of a torque key to lock the locking device, FIG. 4*a* shows a cross section of the torque key of FIG. 3 along the line IV—IV, and FIG. 4*b* shows the cross section of FIG. 4*a* for another operating position of the torque key.

DESCRIPTION OF THE PREFERRED EMBODIMENTS

Figure 1:
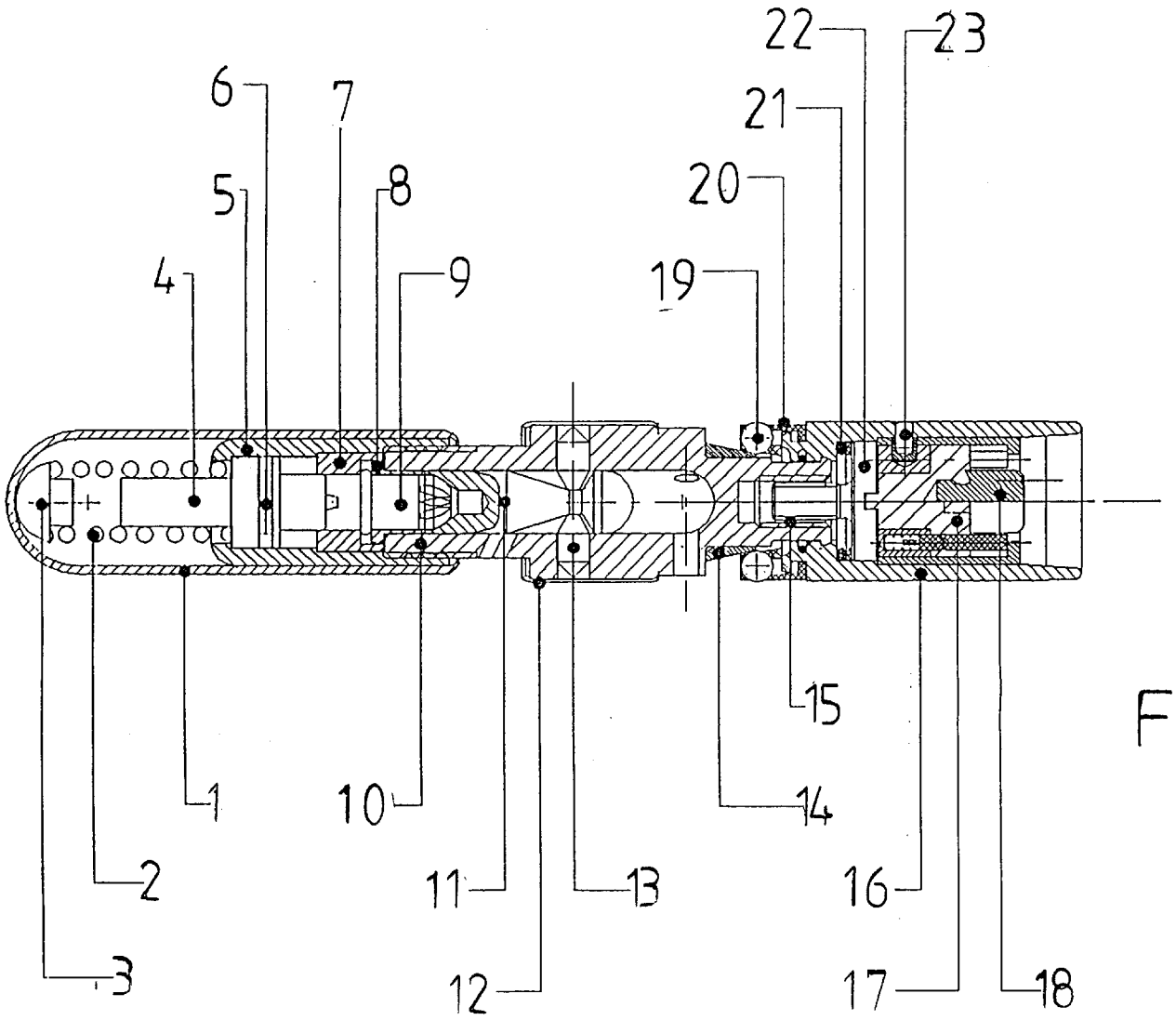

The locking device shown in FIG. 1 includes a locking part or a central casing 10 with a bottom hole, in which a piston 11 is movably mounted with a conical shape between its end portions providing a bearing surface against the bottom hole. A number of pins 13 bearing radially movable in radial holes against the narrowest portion of the piston 11 are resting on the central casing 10. The pins 13 being numerous, e.g. six, are equally spaced around the periphery of the central casing 10 with such a length that their outer end facing from the piston is lying just inside the outer circumference of the central casing, the pins 13 being kept in place by means of a fixating bushing 12. Behind the piston 11 a bushing 8 is provided in the bottom hole, in which a cartridge 9 is placed and a guiding sleeve 7 for an impact pin 4 is lying behind the bushing 8. The bushing 8 and the guiding sleeve 7 are placed within a sleeve 5 surrounding one end of the central casing 10 and also providing a guide for the impact pin 4. Between the impact pin 4 and a domed sleeve 1, glidingly mounted with a little clearance around the sleeve 5, an impact spring 2 is provided resting with one end against a pin cap 3 within the domed sleeve 1 and with the other end against the impact pin 4. The domed sleeve 1 loaded by the spring 2 grips with a downwards bent end around the wedge of the sleeve 5 keeping the domed sleeve 1 in position against the spring force. The pin cap 3 is rounded off as well as the end of the domed sleeve 1 so that they might be relatively rotated. The impact spring 2 is preloaded and acts on the impact pin 4 with a predetermined force so that the impact pin 4 is kept in position by means of one or several breakpins or safety pins 6.

The described device operates in such a way that the impact pin 4 is released when a least specified axial force is applied against the domed sleeve 1. Independent of the application speed and/or rotation when trying to drill away the locking device the breakpin 6 is sheared off and releases the energy stored in the impact spring 2 thereby thrusting the impact pin 2 against the cartridge 9. The inserted somewhat preset impact spring 2 provided with the pin cap 3 on the inside of the dome of the domed sleeve 1 and the clearance between the doomed sleeve 1 and the sleeve 5 provides an effective protection, also when the whole doomed sleeve 1 rotates, manufactured in a material hardly affected by a drill. The guiding sleeve 7 together with the sleeve 5 provides a linear motion of the impact pin 4.

The other, right end of the central casing 10 in FIG. 1 is attached to a cylindrical casing 16, in which is provided a lock cylinder of a type known per se. The lock cylinder 17 has a central dowel 18 in a hardened material, such as hardened steel, the central dowel 18 preventing anybody to drill into the locking device to reach any part there behind. The lock cylinder 17 engages with a ridge a groove in the head of a screw 22, in its turn being threaded into a recess provided with an insert thread 15. The recess is positioned at the end of the first locking part or the central part 10, protruding at said end with a dowellike elongation into the cylinder casing 16. The lock cylinder 17 is seated into the casing of the locking part 16 and is fixed against pulling-out by means of a fixation pin 23 becoming inaccessible when the locking device is inserted into the barrel (not shown) of a weapon or a similar item. Between the head of the screw 22 and the bottom of the cylindrical casing 16 a friction element 21 is provided in the form of a washer and a compressible packing. Alternatively, the friction element 21 is replaced by a spring with a suitable shape and spring force. During assembly the driving screw 22 is coupled without any clearance to the lock cylinder 17 and is preset against the friction element 21 in the cylinder casing 16, the lock cylinder 17 being fixed by means of the hardened pin 23. The lock cylinder 17 provides a butt feeling and is effectively eliminating any possible unpicking.

Figures 2A, 2B, 2C, 2D, 2E:
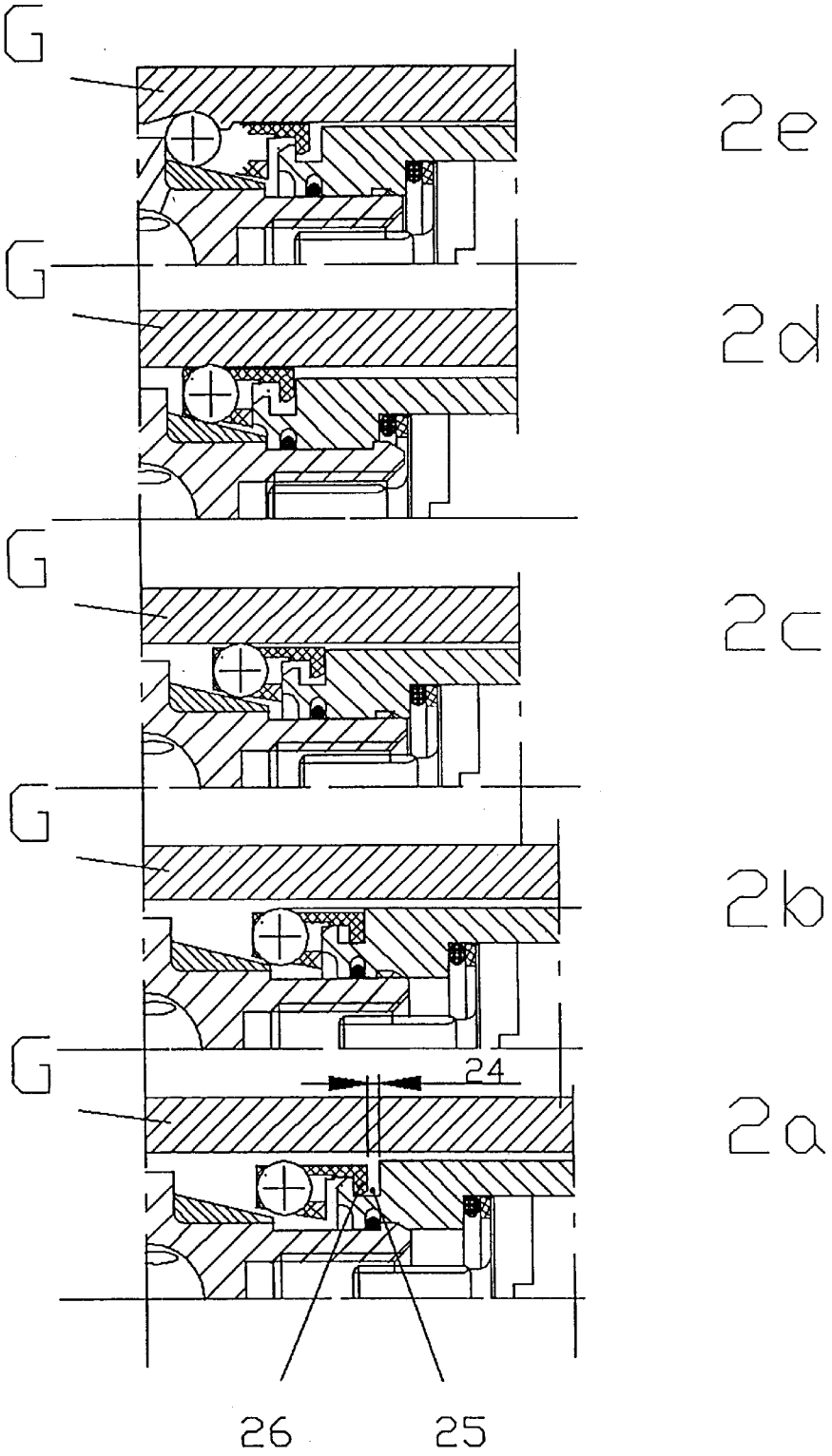

At the end of the cylindrical casing 16 facing the locking part or the central casing 10 a ball retainer 20 is provided with with locking means such as several balls 19 around the periphery of the dowellike prolongation of the cylindrical casing 10. Said dowellike prolongation or end of the cylindrical casing is around its periphery provided with or shaped as a ramp or deflecting portion 14 increasing tapered in diameter in a direction from the cylindrical casing 16. When inserting the locking device in a gun barrel G or a similar item in accordance with FIGS. 2*a* and 2*b* the balls 19 will during a rotation of the lock cylinder 17 and thereby a contraction of the lock parts 16 and 10 travel up on the ramp and by means of friction against the gun barrel G inner mantle surface keep the locking device in position in the barrel in accordance with FIG. 2*c*. The ball retainer 20 is movably suspended with a small clearance 24 in that an annular flange 25 on the ball retainer engages a likewise annular recess 26 in the cylindrical casing 16 in accordance with FIGS. 2*a* to 2*e*. When inserting the locking device in the gun barrel according to FIG. 2*a* the ball retainer flange 25 is pushed to the left, whereas it after an insertion and rotation of the lock cylinder 17 moves to the right in the recess 26 to contact the right recess wall, as shown in FIGS. 2*b* and 2*c*. If somebody forcibly engages the locking device to drag it out of the gun barrel the balls 19 will travel further up on the ramp 14 according to FIG. 2*d* and are more heavily pressed against the inner barrel mantle surface. During a continued withdrawal the balls 19 will travel even further up on the ramp 14 as the ball retainer flange 25 is moved to the left in the recess 26 according to FIG. 2*e*, the balls then being pressed into the gun barrel material and any withdrawal of the locking device being made impossible by means of the balls 19 contacting the central casing wall, where the central casing 10 transits to its tapered end. In this position also the ball retainer 20, made of a simpler material such as plastics or similar, might have burst in accordance with FIG. 2*e*.

Thus the ball retainer 20 is pressing the balls 19 against the taper 14 and the cylindrical wall for the cartridge position with an axial motion achieved by means of rotation via the locking cylinder 17, the driving screw 22 and a specified torque. An axial locking effect is provided in the locking device withdrawal direction and, moreover, the balls 19 achieve a rotation of the complete locking device when radially damaged. The balls will of course, in an effort to expel the locking device by means of pressure applied on the domed sleeve 1, travel up on the ramp 14 and lock 13 the locking body 10, 16 in the gun barrel or similar in cooperation with the released pins. The cylindrical casing 16 is conveniently provided with a length as to e.g. for a shot-gun makes it impossible to fold up the barrel and the stock illustrating an unloaded and unusable weapon not possibly to be used to threaten any person. The fixating pins 23 are heat treated and not removable, making a drilling out impossible both radially and axially in its operating direction.

Figure 3:
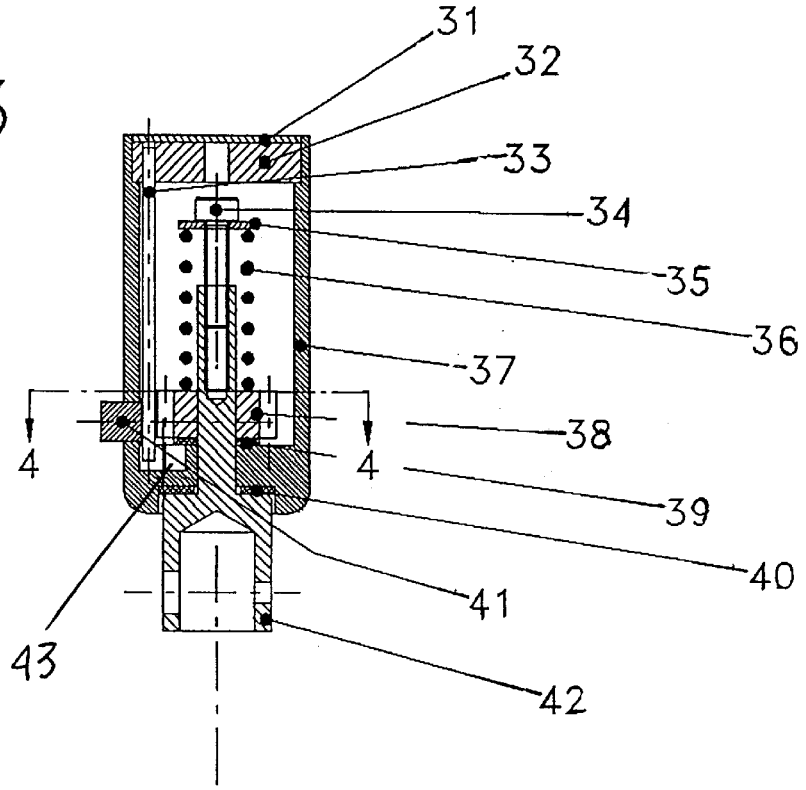
Figure 4A:
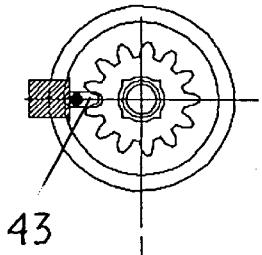
Figure 4B:
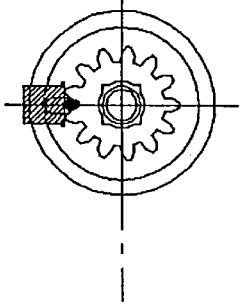

In FIGS. 3, 4*a* and 4*b* a torque key is shown to act on the lock cylinder 17. FIG. 3 shows a longitudinal section of the torque key including a casing 37, in which a central shaft of a sleeve 42 is mounted, in which sleeve 42 the key is inserted for the locking device 17. The mounting is achieved by means of two fibre washers 39, 40 and the central shaft is retained in the casing by means of an indexing wheel 38. A screw 34 is inserted in the central shaft and a spring 36 is placed between the head of the screw 34 and the indexing wheel 38, the spring resting on the head of the screw 34 by means of a washer 35. At the opposite end of the casing 37 facing the sleeve 42 a cover 32 is mounted and on it a marking plate 31. In the cover 32 a locking wire 33 is stretched continuing into the casing up to and passing the indexing wheel 38, the free end of the locking wire 33 running in a radial groove 43 in the casing 37. Said free end of the locking wire 33 in the groove 43 can engage one of the tooth gaps of the indexing wheel 38 by means of a button 41, as shown in FIG. 4*b*, illustrating as well as FIG. 4*a* a cross section of the torque key casing 37 along line IV—IV. Thus, FIG. 4*a* shows the position with the locking wire 33 engaging the indexing wheel 38.

The torque key described above operates as follows: As already mentioned above the key for the locking device 17 is inserted in the sleeve 42 and the torque key casing 37 providing a hand grip is turned until a desired torque is achieved, the locking device locking elements or balls 19 then being pressed against the gun barrel with the desired locking force, as shown in FIG. 2*c*. With this torque the friction between the washers 39,40 and the casing 37 is overcome and the casing or the hand grip 37 is rotated, the sleeve 42 and the inserted key (not shown) remaining fixed. For detaching the key from the locking device the button 41 is pressed in so that the locking wire 33 engages one of the tooth gaps of the indexing wheel 38, the casing 37 then being rotated against the locking direction until the key can be removed from the locking cylinder 17.

The torque key described above might of course also be used for other purposes such as tightening small screws, nuts, etc, a corresponding tool then to be inserted in the sleeve 42. For adjusting a desired torque the screw 34 might be prolongated to a position above the cover 32 and the casing 37 be provided with a convenient scale, on which e.g. the position of the supporting washer 35 of the spring 36 can be read.

I claim:

1. A locking device adapted to fit into a barrel of a weapon, the locking device comprising:

a first casing have first and second end portions with said second end portion including a deflection portion, a second casing having first and second end portions, a lock cylinder mounted within said first end portion of said second casing, outwardly displacable locking members carried by said second end portion of said second casing and being engageable with said deflection portion of said second end portion of said first casing, and means for assembling said second end portion of said first and second casings to one another such that said locking members are progressively outwardly displaced by said deflection portion of said second end portion of said first casing both when said first casing is urged toward said second casing and when said second casing is urged toward said first casing whereby, when said locking device is placed into a barrel, a force applied to the locking device to urge said first and second casings toward one another will cause the locking members to be increasingly compressed against an inner surface of the barrel, thereby preventing the removal of the locking device from the barrel.

2. The locking device of claim 1 in which said second end portion of said first casing extends within said second end portion of said second casing and includes a threaded bore, a screw rotatably supported within said second end portion of said second casing and threadingly engaged with said threaded bore of said second end portion of said first casing, said locking cylinder engaging said screw so as to urge said screw against a compression element mounted within said second end portion of said second casing, whereby said first and second casings are moveable toward one another by compression of said compression element.

3. The locking device of claim 2 including a fixation pin carried by said second casing and engaging said locking cylinder to thereby prevent removal of said locking cylinder from said second casing.

4. The locking device of claim 2 in which said deflection portion of said second end of said first casing is formed as a tapered ramp which extends outwardly away from said second end portion of said second casing, and said locking members including balls moveable along said tapered ramp when said first and second casings are moved relative to one another.

5. The locking device of claim 4 including a retainer cage mounted to said second end portion of said second casing, said balls being movably retained within said retainer cage.

6. The locking device of claim 5 wherein said locking cylinder includes a rotatable central dowel formed of a hardened metal whereby said locking cylinder is protected from tampering by use of a drill.

7. The locking device of claim 5 in which said compression element includes a washer and a compressible packing.

8. The locking device of claim 5 wherein said first casing includes a plurality of radially oriented openings therein, a plurality of locking pins movably mounted within said radially oriented openings, a piston member movably mounted within said first casing from a first position wherein said locking pins are retained within said first casing to a second position wherein said piston member forces said locking pins so as to extend outwardly from said radially oriented openings to thereby lock said locking device within a barrel, and an explosive charge member mounted within said first casing and means for activating said explosive charge member to urge said piston member from said first to said second position.

9. The locking device of claim 8 in which said means for activating said explosive charge member includes an impact pin moveable from a first position in spaced relationship with respect to said explosive charge member to a second position to engage said explosive charge member, resilient means normally urging said impact pin against a safety pin for retaining said impact pin in said first position, said safety pin being breakable by application of increased pressure to said impact pin whereby said resilient means thereafter drives said impact pin to said second position.

10. The locking device of claim 9 in which said impact pin is mounted within a sleeve extending outwardly from said first end portion of said first casing, said sleeve having an outer domed end, said sleeve being slidably moveable with respect to said first casing, a pin cap mounted within said sleeve against said domed end and said resilient means extending between said pin cap and said impact pin.

11. The locking device of claim 10 in which said sleeve is rotatably supported relative to said first end portion of said first casing, said sleeve being formed of a hardened metal material such that said sleeve cannot be tampered with by drilling.

12. The locking device of claim 1 wherein said first casing includes a plurality of radially oriented openings therein, a plurality of locking pins movably mounted within said radially oriented openings, a piston member movably mounted within said first casing from a first position wherein said locking pins are retained within said first casing to a second position wherein said piston member forces said locking pins so as to extend outwardly from said radially oriented openings to thereby lock said locking device within a barrel, and an explosive charge member mounted within said first casing and means for activating said explosive charge member to urge said piston member from said first to said second position.

13. The locking device of claim 12 in which said means for activating said explosive charge member includes an impact pin moveable from a first position in spaced relationship with respect to said explosive charge member to a second position to engage said explosive charge member, resilient means normally urging said impact pin against a safety pin for retaining said impact pin in said first position, said safety pin being breakable by application of increased pressure to said impact pin whereby said resilient means thereafter drives said impact pin to said second position.

14. The locking device of claim 13 in which said impact pin is mounted within a sleeve extending outwardly from said first end portion of said first casing, said sleeve having an outer domed end, said sleeve being slidably moveable with respect to said first casing, a pin cap mounted within said sleeve against said domed end and said resilient means extending between said pin cap and said impact pin.

15. The locking device of claim 14 in which said sleeve is rotatably supported relative to said first end portion of said first casing, said sleeve being formed of a hardened metal material such that said sleeve cannot be tampered with by drilling.

16. The locking device of claim 12 in which said second end portion of said first casing extends within said second end portion of said second casing and includes a threaded bore, a screw rotatably supported within said second end portion of said second casing and threadingly engaged with said threaded bore of said second end portion of said first casing, said locking cylinder engaging said screw so as to urge said screw against a compression element mounted within said second end portion of said second casing, whereby said first and second casings are moveable toward one another by compression of said compression element.

* * * * *